US008132830B2

(12) United States Patent
Brehm et al.

(10) Patent No.: US 8,132,830 B2
(45) Date of Patent: Mar. 13, 2012

(54) SECURITY AND/OR VALUABLE DOCUMENT

(75) Inventors: Ludwig Brehm, Adelsdorf (DE); Klaus Weber, Zirndorf (DE)

(73) Assignee: Leonhard Kurz Stiftung & Co. KG, Furth (DE)

( * ) Notice: Subject to any disclaimer, the term of this patent is extended or adjusted under 35 U.S.C. 154(b) by 532 days.

(21) Appl. No.: 10/599,066

(22) PCT Filed: Mar. 21, 2005

(86) PCT No.: PCT/DE2005/000528

§ 371 (c)(1),
(2), (4) Date: Sep. 19, 2006

(87) PCT Pub. No.: WO2005/095118

PCT Pub. Date: Oct. 13, 2005

(65) Prior Publication Data

US 2008/0036197 A1 Feb. 14, 2008

(30) Foreign Application Priority Data

Mar. 26, 2004 (DE) ..... 10 2004 014 778

(51) Int. Cl.

| | |
|---|---|
| ***B42D 15/00*** | (2006.01) |
| ***B42D 15/10*** | (2006.01) |
| ***D21F 11/00*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl. ..... 283/110; 283/109; 283/72; 162/114

(58) Field of Classification Search ..... 283/72, 283/84, 109, 110; 162/114

See application file for complete search history.

(56) References Cited

U.S. PATENT DOCUMENTS 4,313,984 A 2/1982 Moraw et al.

(Continued)

FOREIGN PATENT DOCUMENTS

CA 2483467 6/2003

(Continued)

OTHER PUBLICATIONS

Linear Expansion Coefficients http://www.engineeringtoolbox.com/linear-expansion-coefficients-d_95.html.*

(Continued)

*Primary Examiner* — Dana Ross
*Assistant Examiner* — Kyle Grabowski
(74) *Attorney, Agent, or Firm* — Hoffmann & Baron, LLP

(57) ABSTRACT

The invention concerns a security and/or value document, in particular a banknote. The security and/or value document has a support (1) of a paper material and an in particular strip-form or thread-form film element (2) which contains one or more optical security features. The support (1) has one or more window-shaped openings (35) which are closed by means of the film element (2) which projects beyond the openings on all sides. Applied to the side of the support (1) of a paper material, which is in opposite relationship to the film element (2), is a sealing layer (4) which covers the surfaces of the film element (2) at least in the region of the openings.

17 Claims, 2 Drawing Sheets

U.S. PATENT DOCUMENTS

| | | | | |
|---|---|---|---|---|
| 4,462,866 | A | 7/1984 | Tooth et al. | |
| 5,342,731 | A | 8/1994 | Kelly et al. | |
| 5,346,259 | A | 9/1994 | Mocilnikar et al. | |
| 5,354,099 | A | 10/1994 | Kaule et al. | |
| 5,648,414 | A | 7/1997 | Bier et al. | |
| 5,714,213 | A * | 2/1998 | Antes et al. | 428/30 |
| 6,036,230 | A * | 3/2000 | Farber | 283/58 |
| 6,343,745 | B1 * | 2/2002 | Bohm et al. | 235/493 |
| 6,428,051 | B1 | 8/2002 | Herrmann et al. | |
| 7,632,380 | B2 | 12/2009 | Doublet | |
| 2002/0027361 | A1 * | 3/2002 | Hardwick et al. | 283/72 |
| 2002/0030360 | A1 * | 3/2002 | Herrmann et al. | 283/72 |
| 2005/0040641 | A1 * | 2/2005 | Cote et al. | 283/72 |
| 2005/0104364 | A1 * | 5/2005 | Keller et al. | 283/72 |
| 2005/0127663 | A1 * | 6/2005 | Heim | 283/72 |
| 2005/0153113 | A1 * | 7/2005 | Hseih et al. | 428/201 |
| 2005/0224203 | A1 | 10/2005 | Boehm et al. | |
| 2007/0029784 | A1 * | 2/2007 | Moreau | 283/72 |

FOREIGN PATENT DOCUMENTS

| | | | |
|---|---|---|---|
| DE | 2165708 | | 7/1972 |
| DE | 4041025 | | 6/1992 |
| DE | 4404128 | | 8/1994 |
| DE | 4334848 | C1 | 1/1995 |
| DE | 4334847 | A1 | 4/1995 |
| DE | 19706049 | | 8/1998 |
| DE | 19840733 | | 9/2000 |
| DE | 10226114 | | 3/2003 |
| EP | 0070172 | | 1/1983 |
| EP | 0251253 | | 6/1987 |
| EP | 0229645 | A1 | 7/1987 |
| EP | 0625431 | | 11/1994 |
| EP | 1386753 | | 2/2004 |
| EP | 1398174 | | 3/2004 |
| EP | 1398174 | A1 | 3/2004 |
| FR | 2767091 | | 2/1999 |
| GB | 1552853 | | 9/1979 |
| GB | 2385298 | | 2/2002 |
| KR | 10-1992-0703342 | T | 12/1992 |
| WO | 95/10419 | | 4/1995 |
| WO | WO 96/28610 | | 9/1996 |
| WO | WO 00/00697 | | 1/2000 |
| WO | WO 00/39391 | | 7/2000 |
| WO | WO0103945 | A1 | 1/2001 |
| WO | WO03/054297 | | 7/2003 |
| WO | WO03/068525 | | 8/2003 |
| WO | WO03070482 | | 8/2003 |
| WO | WO 03/097937 | | 11/2003 |
| WO | WO9510419 | | 4/2005 |

OTHER PUBLICATIONS

Notice of Allowance issued Oct. 14, 2008 by the Korean Intellectual Property Office for Korean Patent Application No. 10-2006-7022338 (related to the subject application by priority).

European Search Report issued Jun. 8, 2009 from related European patent application EPO 09004025.4.

Lexikon der grafischen Technik, p. 353, third paragraph (translation of which is included as the last page thereof.).

Van Renesse, Rudolf L., "Optical Security Document", pp. 274-275, Artech House, 1993, ISBN 0-89006-619-1.

"Ullmann's Encyclopedia of Industrial Chemistry", Sixth Completely Revised Edition, vol. 24, pp. 596-597, 2003, Wiley-VCH, Weinheim.

* cited by examiner

SECURITY AND/OR VALUABLE DOCUMENT

This application claims priority based on an International Application filed under the Patent Cooperation Treaty, PCT/DE2005/000528, filed on Mar. 21, 2005 and German. Application No. 102004014778.7, filed on Mar. 26, 2004.

BACKGROUND OF THE INVENTION

The invention concerns security and/or value documents, for example banknotes, cheques, share certificates, credit cards, software certificates or identity cards or passes, which comprise a support of a paper material with one or more window-shaped openings and a preferably strip-form or thread-form film element.

There is a need for security and/or value documents to be provided with security features which make it difficult to forge those documents and as far as possible to prevent that. It is already known in that respect for security and/or value documents to be provided with transmissive security elements which can be checked when viewed in a transillumination mode and which afford a particularly high level of security against imitation by means of a colour copier.

It has already been proposed in that respect for security threads to be introduced into value documents, which are exposed in region-wise manner at the surface in order to be able to check additional security elements on the thread, for example print patterns, diffraction structures and so forth. Thus for example EP-A-0229645 describes the production of a security paper with an incorporated security element in the form of a thread in which two separate layers of paper are formed, which have regions of smaller thickness or openings. The two paper layers are brought together and the band which serves as a security element is introduced during the operation of bringing them together. In that situation the arrangement can also be so selected that the openings in the two paper layers are in mutually superposed coincident relationship so that the security element is exposed at the same location on the paper web on both sides. That also permits the security element to be viewed in the transillumination mode.

That approach however suffers from the disadvantage that, as security threads must be incorporated into the paper web they may only be of comparatively narrow width in order not to interfere with the paper in itself being held together. That is the case in particular if the paper web is exposed in coincident relationship on both sides in order to permit a security element to be viewed in a transillumination mode. In addition it is necessary here to use security threads of relatively large thickness so that the security threads afford adequate tensile strength in spite of their small width. That thickening effect which occurs in a relatively narrow region results in poor planar positioning of the sheets and thus gives rise to problems in further processing of the value document.

In addition DE-A-4334847 describes a value document in which window-shaped openings are subsequently produced in the support of the value document by means of a stamping or cutting operation. Those openings are then closed by means of a cover film which is transparent at least in region-wise manner and which projects beyond the openings on alt sides and which is fixed on the surface of the support over the full area thereof. That arrangement makes it possible to use a cover film which has one or more security elements and which is of comparatively large dimensions so that, in comparison with the above-described windows which are produced in production of the paper, it is possible to implement larger windows and the thickness of the film element can be reduced. In terms of practical implementation of that procedure however it has been found that here too with relatively large window widths, problems can occur in further processing of the security and/or value documents.

SUMMARY OF THE INVENTION

The invention is now based on the object of proposing a security and/or value document which is suitable for the use of security elements which can be checked in a transillumination mode, and can be subjected to further processing without any problem.

That object is attained by a security and/or value document which comprises a support of a paper material with one or more window-shaped openings and an in particular strip-form or thread-form film element with one or more optical security features, wherein the one or more window-shaped openings are closed by means of the film element which projects beyond the openings on all sides, and a sealing layer which covers the surface of the film element at least in the region of the openings is applied to the side of the support of a paper material, which is in opposite relationship to the film element.

In that respect the invention is directed in particular to film elements and/or sealing layers which do not completely cover the two sides of the paper support so that the paper support, besides temperature influences, is accordingly also exposed to further environmental influences such as moisture. In that situation the film element covers a side of the paper support preferably up to a maximum of 50% of its area, in particular up to a maximum of 20% of its area. Preferably the film element is of such a nature in terms of its area extent that the spacing between the edge of the film element fixed on the paper support and an edge of the opening, which is at the shortest spacing in relation thereto, corresponds at maximum to the length, width or diameter of the respective opening, but preferably corresponds at a maximum to 50% of the length, width or diameter of the respective opening.

The invention is based on the realisation that, when the window-shaped openings of the paper support are closed by means of the film element, the specific material properties of the paper material from which the support is made can lead to problems in terms of further processing of the security and/or value document. Thus the expansion characteristics of the paper material are both dependent on moisture, the fibre direct-ion of the paper material and the temperature. As the openings in the support, of a paper material are closed by means of a film element, the expansion characteristics of which differ greatly from those of the paper support, influences in further processing, for example moisture or changes in temperature, can seriously worsen the result of the further processing procedure. The later use of the finished security and/or value document can also be adversely affected. It is here that the invention provides a remedy, the sealing layer provides that the openings are stabilised at the rear side so that further processing of the security and/or value document can be effected with the available technologies. Further advantages are also enjoyed in subsequent use of the security and/or value document as there too temperature and moisture influences have low levels of influence on the appearance of the security and/or value document. The invention makes it possible for the width of security elements which are suitable for transillumination, in conjunction with the advantages of paper as the support material, to be further increased and thus make it possible to further increase the safeguard against forgery of security and/or value documents.

Advantageous configurations of the invention are recited in the appendant claims.

In accordance with a preferred embodiment of the invention the sealing layer covers the surface area of the film element at least to 80%. Stabilisation of the film element at its rear side over a full area in that way substantially prevents moisture from penetrating into the paper support, whereby the expansion characteristics of the paper support are substantially influenced. In addition that provides for mechanical compensation and adjustment in relation to the film element, whereby the occurrence of bulge configurations is made more difficult.

Further advantages are afforded if the area of the sealing layer is between 100 and 120% of the area of the film element. That affords on the one hand tolerances for application of the sealing layer in accurate register relationship and on the other hand that avoids disadvantageously influencing the processing procedure due to an excessively large sealing layer.

It is desirable for the sealing layer to be transparent so that it does not influence the graphic configuration of the security and/or value document.

The forgery-proofness of the security and/or value document can be further improved if the sealing layer and/or the film element is at least region-wise overprinted with a print. That provides that changes to the film element or the sealing layer, for example removal of the film element, become immediately visible. Such overprinting, for example by means of steel intaglio printing, leads to a strong influence in respect of the temperature and moisture conditions to which the security and/or value document is exposed so that the result here is greatly improved by the use of the invention.

In accordance with a preferred embodiment of the invention the sealing layer comprises a lacquer layer which is preferably applied to the paper support by printing in a thickness of about 2 to 10 μm. In particular a screen printing process, preferably printing by means of a flat screen, is appropriate here as the printing process. In this respect particularly good results can be achieved when applying by printing a relatively thick lacquer layer in the range of 2 to 10 μm. Such a lacquer layer reliably prevents the ingress of moisture and has the necessary thickness to act as a "counterweight" for the expansion characteristics of the film element. Preferably the thickness of the lacquer layer and the composition thereof are so selected that the lacquer layer is approximately of an expansion coefficient which corresponds to that of the film element. That makes it possible to almost completely prevent bulges being formed.

In this respect the term "expansion coefficient" is used to denote on the one hand the thermal length expansion coefficient $\alpha$ (linear thermal expansion coefficient). Upon a change in temperature in the region of the window-shaped opening in the support the lengths of the film element and the sealing layer change in dependence on the respective material used for forming them. If therefore upon a change in temperature the film element expands or shrinks to a greater degree than the sealing layer, that results in unwanted bulging in the region of the window-shaped opening.

On the other hand the term "expansion coefficient" further means expandability of the film element and the sealing layer which is predetermined by way of the material-dependent modulus of elasticity E or the inverse thereof, the expansion value 1/E. Upon a mechanical loading applied to the film element and the sealing layer in the region of the window-shaped opening, for example due to folding, bending, creasing or the like, the materials are deformed in dependence on their modulus of elasticity, in which case the fact of exceeding the elasticity limit of a material leads to permanent deformation. If now with substantially the same amount of force being applied to the film element and the sealing layer, for example the elasticity limit of the film element is exceeded earlier than that of the sealing layer, then the film element is plastically deformed while the sealing layer which is only elastically deformed tries to return to its initial state. That results in unwanted permanent bulges which can be avoided when the modulus of elasticity of the film element is matched to that of the sealing layer.

In accordance with a further preferred embodiment of the invention the sealing layer is produced by means of a film which is counter-laminated in register relationship, preferably a cold or hot stamping film which is to counter-laminated in register relationship. In that case the counter-laminated film preferably comprises a lacquer layer and an adhesive layer, the thickness of the lacquer layer preferably being in the range of about 2 to 10 μm, for the reasons already specified hereinbefore. In addition it is also possible for the counter-laminated film used to be a film comprising an adhesive layer and a film body, for example a PET film of a thickness of 12 to 16 μm.

It is particularly preferred in that respect if the counter-laminated film has an expansion coefficient which approximately corresponds to that of the film element. As already described hereinbefore in relation to use of a lacquer layer as the sealing layer, the term expansion coefficient is used on the one hand to denote the length expansion coefficient and on the other hand the modulus of elasticity.

In general it has proven to be advantageous if the sealing layer has an expansion coefficient which approximately corresponds to that of the film element, in particular the expansion coefficient corresponding to a length expansion coefficient or a modulus of elasticity.

In that respect it has proven to be advantageous if the sealing layer has a length expansion coefficient which differs from a length expansion coefficient of the film element by not more than 10%, preferably not more than 5%. Upon a change in temperature therefore the sealing layer experiences approximately the same change in length as the film element so that no or substantially no bulging in the region of the window-shaped opening of the support occurs. That is found to be particularly advantageous in particular when stacking for example banknotes or when subjecting the support to further processing in an automated process in which a flat surface is required, for example in the printing operation, stamping operation or the like.

It is further preferable if the sealing layer has a modulus of elasticity which differs from that of the film element by not more than 10%, preferably not more than 5%. Such a configuration for the film element and the sealing layer permits optimum handling of the finished security or value document. Banknotes are usually also mechanically stressed in the region of the window-shaped openings, for example by folding. In the event of defect matching of the modulus of elasticity of the sealing layer to that of the film element, that can result in permanent bulges which on the one hand result in optical impairment of the banknote and which on the other hand can lead to technical errors and faults in automatic cash machines.

BRIEF DESCRIPTION OF THE DRAWINGS

The invention is described by way of example hereinafter by means of a number of embodiments with reference to the accompanying drawings in which.

DETAILED DESCRIPTION OF THE INVENTION

Figure 1:
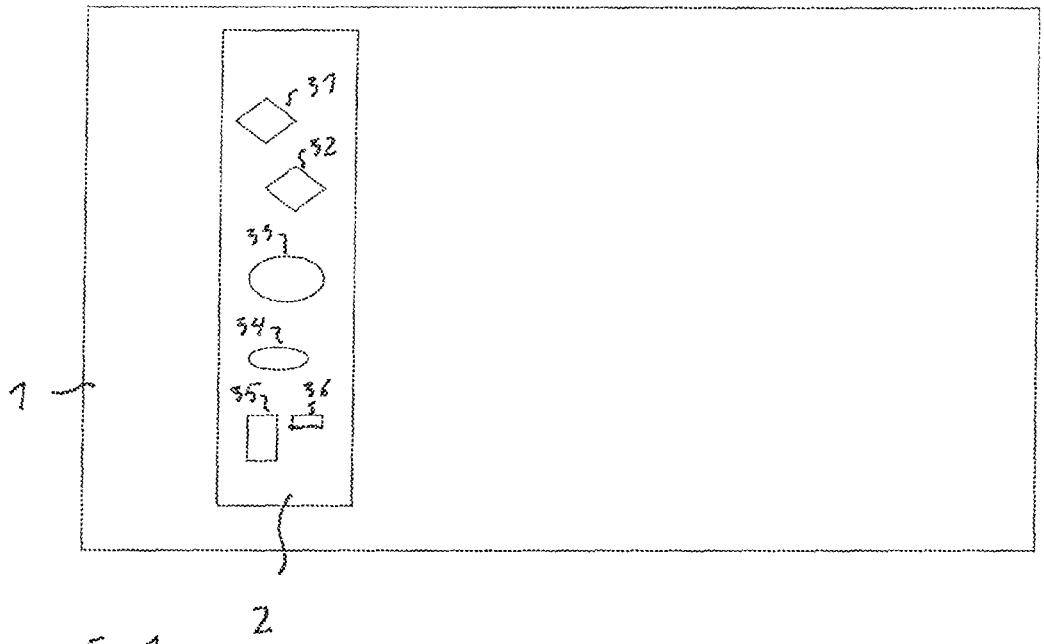
FIG. 1 shows a diagrammatic representation of a value document according to the invention.

The value document shown in FIG. 1 represents a banknote. It is however also possible for that value document to represent a cheque, a traveller's cheque, a share certificate or software certificate, a security document, for example an identity card or pass or the like.

The value document shown in FIG. 1 has a support 1 of a paper material. The paper material is preferably a paper quality which is used for banknotes and which can be provided in known manner with water marks, special printing thereon and other security elements. Such further security elements comprise for example steel intaglio printing, microprinting or a reflective security feature, for example a hologram or a colour change element.

The support 1 of a paper material is preferably of a thickness of about 100 μm. The support 1 is normally part of a paper web or a paper sheet in production of the value document, value documents as shown in FIG. 1 being cut out of the part of the paper web or sheet after it is finished.

As shown in FIG. 1 the support 1 has a plurality of window-like openings 31 to 36. Those window-like openings can be arranged in any arrangement and configuration in the region of a film element 2. In this case before application of the film element 2 the openings 31 to 36 are produced in the paper sheet by means of a stamping or cutting operation, preferably by means of conventional stamping processes, or by means of laser or water jet cutting. Prior to application of the film element 2 however it is also possible to shape a depression in the region of the surface 2 to which the film element 2 is to be applied, by means of an embossing or stamping tool, with the film element then being laid in the depression. By virtue of the production of a depression of that nature, the thickness of the value document 1 can be reduced, the paper material is smoothed, and subsequent detachment of the film element is made more difficult.

The film element 2 is preferably of a strip-shaped or thread-shaped form, preferably with a strip width in the region 4 to 30 mm. Preferably in that case the film element 2 extends transversely over the entire width or length of the support 1, thereby simplifying application of the film element 2 from the point of view of production engineering.

Figure 2:
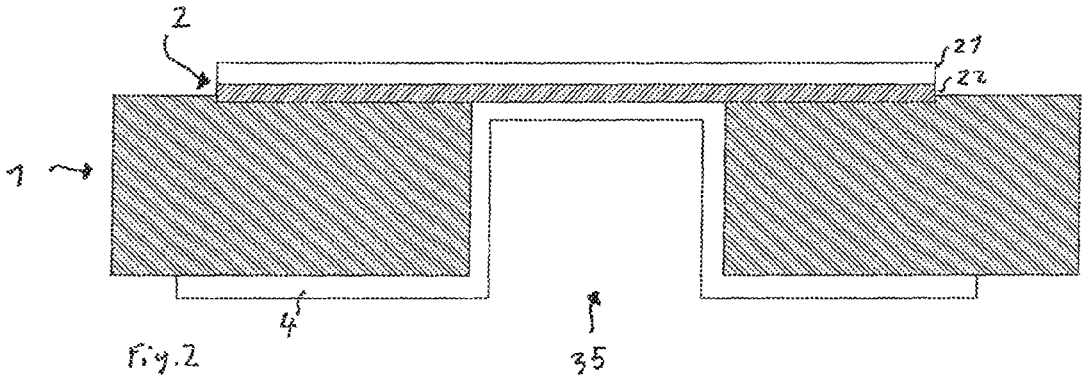
FIG. 2 shows a diagrammatic representation of a section through the value document of FIG. 1.

FIG. 2 shows a section through a partial region of the value document shown in FIG. 1, in the region of the openings 35, FIG. 2 shows the support 1, the film element 2 with a decorative layer 22 and a support film 21 as well as a sealing layer 4 which extends over the region of the opening 35.

As shown in FIGS. 1 and 2, the window-like opening 35 is a through-hole passing through the thickness of support 1 and is closed by means of the film element 2, wherein the film element 2 is fixed on the surface of the support 1 over the full area thereof by means of an adhesive layer in such a way that the film element is firmly fixed on the surface of the support and projects beyond the window-like openings 31 to 36 on all sides so that the film element 2 adheres fixedly to the surface of the support 1 around the openings 31 to 36. As shown in FIG. 2 in that case the film element 2 is preferably fixed on the paper material of the support 1 by using heat and pressure, for example by means of a special stamping roller, by the adhesive layer being activated by the heat and the pressure. At the same time, a depression is produced in the region of the film element by the pressure applied, thereby achieving the advantages already outlined above. It is however also possible for the film element 2 to be applied to the paper material by means of a cold stamping process and the adhesive layer can be for example an adhesive which can be hardened by means of UV radiation or a cold-hardening, pressure-sensitive adhesive.

The structure of the film element 2 will now be described by way of example with reference to FIG. 3.

Figure 3:
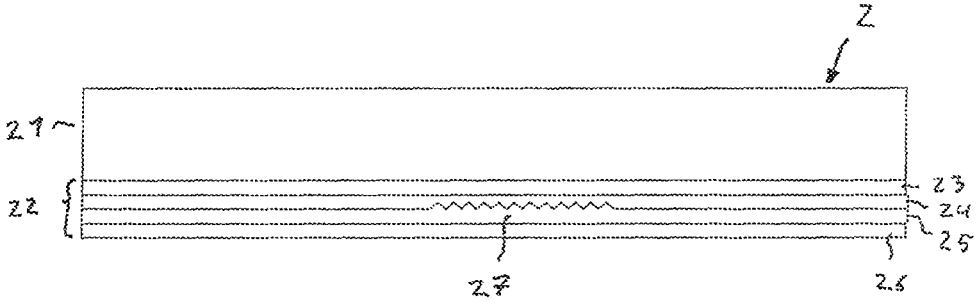
FIG. 3 shows a detail view of a film element which is used in the value document of FIG. 2.

FIG. 3 shows the film element 2 with a transparent carrier film 21 and the decorative layer 22.

The carrier film 21 comprises a PET or BOPP film of a layer thickness of 10 to 50 μm. In this respect the function of the carrier film 21 is to provide the necessary stability for bridging over the openings 31 to 36 so that the thickness which is preferably to be selected for the support film 21 is substantially determined by the width of the openings 31 to 36. In that respect, with a suitable choice for the layers of the decorative layer 22 and the sealing layer 4, it is however also possible for the composite assembly of those layers to already have the necessary mechanical stability so that it is possible to dispense with the support film 21.

In the embodiment shown in FIG. 3 the decorative layer 22 has a bonding layer 23, a first lacquer layer 24, an optical separation layer 25 and an adhesive layer 26.

The bonding layer 23 is of a thickness in the region of 0.2 to 2 μm and is applied to the support film 21 by means of a printing process. Under some circumstances it is also possible to dispense with the bonding layer 23 if adequate adhesion between the support film 21 and the first lacquer layer 24 is already achieved or if the support film 21 is dispensed with.

The first lacquer layer 24 is a replication lacquer layer comprising a thermoplastic or crosslinked polymer in which a diffractive structure 27 is replicated by means of a replicating tool, under the action of heat and pressure.

By way of example the lacquer used for the first lacquer layer 24 can be a lacquer of the following composition, which is applied over the entire surface area with a weight in relation to surface area of about 2.2 g/m$^2$ after drying:

| Composition: | Proportions by weight: |
|---|---|
| High-molecular PMMA resin | 2000 |
| Silicone alkyd oil-free | 300 |
| Non-ionic wetting agent | 50 |
| Low-viscosity nitrocellulose | 750 |
| Methyl ethyl ketone | 4200 |
| Toluene | 2000 |
| Diacetone alcohol | 2500 |

After drying of the lacquer, for example in a drying passage at a temperature of 100 to 120° C., the diffractive structure 27 is produced by embossing by means of a stamping die.

The optical separation layer 25 is then applied to the first lacquer layer 24. The optical separation layer 25 can in this case involve a transparent material which is markedly different in its refractive index from the refractive Index of the lacquer layer 24 so that the diffractive structure 27 provides a transparent security feature. It is also possible for a metal layer to be applied to the first lacquer layer 24 partially or over the full surface area, as the optical separation layer 25.

The material used for such a metal layer can be for example aluminium, chromium, gold or silver or an alloy of those metals. In that case the metallisation is preferably applied to the first lacquer layer 24 by means of vapour deposition or sputtering, Instead of a metallisation it is also possible for an HRI or LRI layer (HRI=high refraction index; LRI=low refraction index) to be applied to the first lacquer layer 24 partially or over the full surface area.

The HRI or LRI layer preferably comprises a suitable dielectric, for example $TiO_2$ or ZnS (for HRI) or $MgF_2$ (for LRI).

In the region of the opening 35 the diffractive structure 27 generates a transmissive security element which has an optical-diffraction effect, for example a hologram or kinegram. In that respect it is also possible to implement one or more of the following security features in the decorative layer 22, instead of the above-described security feature or in addition to that security feature, in the region of the opening 35.

In the region of the opening 35, it is possible to provide a thin-film layer system or a colour layer with thin-film layer pigments or a cholesteric liquid crystal material, which generate a viewing angle-dependent colour shift effect and thus afford the viewer a colour change element, as the security feature. Such a thin-film layer system for example comprises a layer composite with an absorption layer, a $\lambda/2$ layer as a spacer layer and a layer whose refractive index differs from that of the spacer layer. It is however also possible for a thin-film layer system of that kind to be made up of a succession of high-refractive and low-refractive layers, for example three to nine or two to ten such layers. The higher the number of layers, the correspondingly sharper is it possible to set the wavelength for the colour change effect. Examples of usual layer thicknesses for the individual layers of such thin-film layer systems and examples of materials which in principle can be used for the layers of such a thin-film layer system are disclosed for example in WO 01/03945, page 5, line 30 to page 8, line 5.

In the region of the opening 35 the decorative layer 22 can further have a polarisation layer comprising for example a layer of oriented and cross-linked liquid crystal polymers. That provides a further security feature in the region of the opening 35.

The decorative layer 22 can further have one or more colour layers which have luminescent and in particular UV or IR fluorescent pigments which are arranged for example in pattern form and which can serve as a further security feature.

The decorative layer 22 can also have one or more colour layers with a security printing, for example a microscript, or one or more layers which are demetallised in pattern form and which constitute a further security feature in the region of the opening 35.

It is possible in that respect to implement any combinations of the above-described security features in the region of the opening 35 in the decorative layer 22.

The adhesive layer 26 is of a thickness in the region of 5 to 6 μm and comprises a thermally activatable adhesive. By way of example an adhesive of the following composition can be used for the adhesive layer 26:

| Composition | | Proportions by weight: |
|---|---|---|
| Toluene | | 2000 g |
| Acetone | | 2100 g |
| High-molecular ethyl methacrylate | Tg 60° C. | 300 g |
| Methacrylate copolymer | Tg 40-80° C. | 700 g |
| Thermoplastic polyvinylacetate | Tg 80-83° C. | 200 g |

-continued

| Composition | Proportions by weight: |
|---|---|
| Ethanol | 2100 g |
| Highly-dispersed silicic acid | 100 g |

That adhesive is applied for example with a line raster with 60 l/cm and an application weight of 5-6 g/m$^2$ to the subjacent layer of the decorative layer portion 22.

On the side of the support 1 which is in opposite relationship to the film element 2, a sealing layer 4 is applied by means of a printing process in the region of the film element 2, after fixing of the film element 2.

It is of particular significance in that respect that the sealing layer 4 is applied to the side of the support 1 which is in opposite relationship to the film element 2, at least in the region of the openings 31 to 36 of the carrier 1, after closure of those openings by means of the film element 2. Applying the sealing layer 4 in that region provides that the cut edges of the paper support 1 are sealed off in relation to the penetration of moisture thereinto, the adhesive layer, which is still exposed, of the film element 2 is sealed and the window-shaped openings are mechanically stabilised.

As shown in FIG. 2 it is further advantageous for the sealing layer 4 to be applied to the side of the support 1 which is in opposite relationship to the film element 2, in a region which slightly overlaps the region of the film element 2, and thus in the entire region of the film element 2 to provide for mechanical stabilisation and sealing of the paper material in relation to moisture penetrating thereinto.

The sealing layer 4 can be applied to the support 1 by printing, pouring, scattering or sprinkling or spraying. Preferably the operation of applying the sealing layer 4 is effected by means of a screen printing process as relatively thick lacquer layers can be applied to the support 1 with a sufficient degree of accuracy by means of such a process. So that the sealing layer 4 can form a mechanical counterpart to the film element 2, a certain thickness is required for the lacquer layer. The sealing layer 4 therefore comprises a lacquer layer of a thickness of 2 to 10 μm, the expansion coefficient of which approximately corresponds to that of the film element 2. In that way it is possible substantially to avoid bulge formation in the region of the film element 2 upon a change in the environmental conditions such as moisture and temperature or mechanical loading.

In principle the lacquer used for forming the sealing layer 4 can be solvent-bearing two-component lacquer, aqueous dispersions and UV lacquer with a high proportion of solids. The lacquer used for the sealing layer 4 can in that respect be a transparent lacquer or also a coloured lacquer. It is also possible for the sealing layer 4 to be composed of prints of different colours, which for example each run out in a respective half-tone. In addition the lacquer used for the sealing layer 4 should be an overprintable lacquer, that is to say a lacquer which is not too excessively cross-linked so that printing ink can adhere thereto.

Thus by way of example a lacquer of the following composition is used as the lacquer for the sealing layer 4:

| Composition: | | Proportions by weight: |
|---|---|---|
| Cyclohexanone | | 2800 g |
| Xylene | | 1400 g |
| Ethylene-vinylacetate copolymer | Tg 65-70° C. | 100 g |

-continued

| Composition: | | Proportions by weight: |
|---|---|---|
| PVC copolymer | Tg 75-80° C. | 500 g |
| PMMA | Tg 115° C. | 500 g |
| Highly-dispersed silicic acid | | 50 g |
| Silicone-based anti-foam agent | | 15 g |

That lacquer is applied by printing by means of a flat screen 77 T, coated with direct emulsion, to the support layer 1 in the above-identified thickness range of 2 to 10 μm and with an application weight, by means of which it is possible to achieve a layer thickness in the above-indicated layer thickness range.

After hardening or cross-linking of the lacquer of the sealing layer 4 the sealing layer 4 and/or the film element 2 is overprinted at least in region-wise manner, thereby providing a further increase in security. In that case the overprinting operation is preferably effected by means of die stamping.

Further embodiments by way of example, of the invention will now be described with reference to FIGS. 4 and 5, in which the sealing layer 4 is formed by a counter-laminated film.

Figure 4:
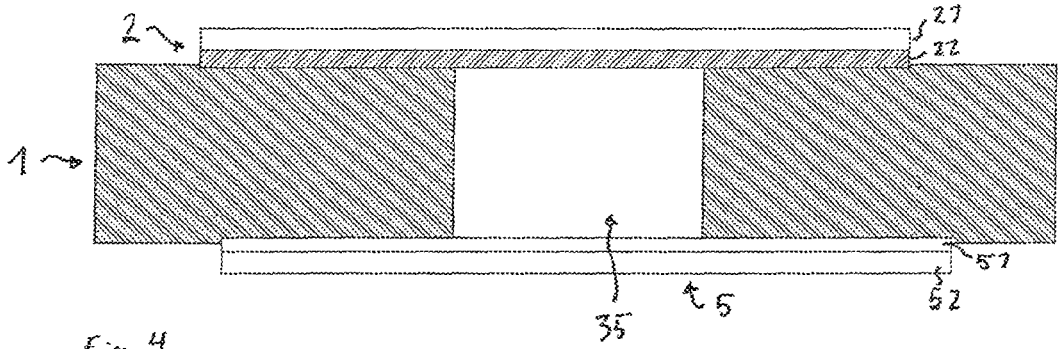
FIG. 4 shows a diagrammatic representation of a section through a value document according to the invention in accordance with a further embodiment thereof.

FIG. 4 shows the support 1, the film element 2 with the support film 21 and the decorative layer 22, the opening 35 and a sealing layer 5 which comprises a counter-laminated film comprising a support film 52 and an adhesive layer 51.

The support 1 and the film element 2 are shaped as described with reference to FIGS. 1 to 3.

The adhesive layer 51 comprises an adhesive which can be activated by pressure or heat or also a UV hardenable adhesive. By way of example the adhesive layer 51 is formed by the adhesive used for the adhesive layer 26 of the film element 2 shown in FIG. 3.

The film 5 is preferably prefabricated in the manner of a hot or cold stamping film and then laminated onto the side in opposite relationship to the film element 2, using pressure and heat or using pressure and UV radiation.

The support film 5 is a transparent PET or BOPP film of a layer thickness in the region of 12 to 16 μm.

Figure 5:
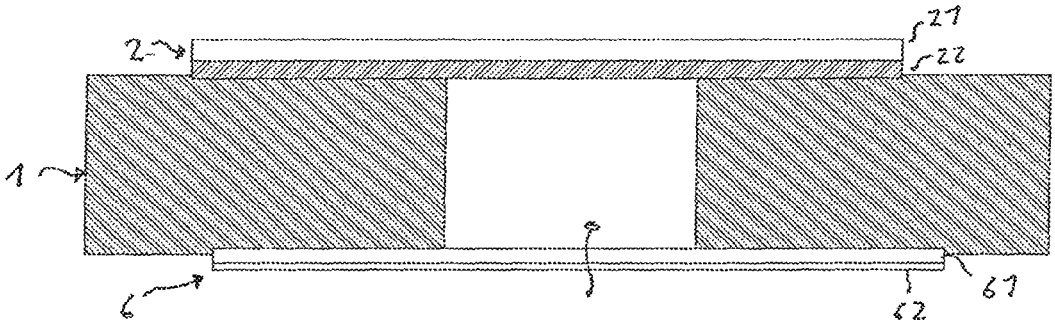
FIG. 5 shows a diagrammatic representation of a section through a value document according to the invention in accordance with a further embodiment thereof.

In the embodiment shown in FIG. 5, instead of the film 5, a film 6 is applied to the side of the support 1 which is in opposite relationship to the film element. The film 6 comprises an adhesive layer 61 and a protective lacquer layer 62 which is preferably of a thickness in the region of 2 to 12 μm. The film 6 is preferably applied to the support 1 as part of a transfer layer of a cold or hot stamping film. The adhesives used for the adhesive layer 26 of the film element 2 can be used as the adhesive for the adhesive layer 61.

The protective lacquer layer 62 is transparent and can be for example of the following composition:

| Composition: | Proportions by weight: |
|---|---|
| Methyl ethyl ketone | 300 |
| Ethyl acetate | 170 |
| Cyclohexanone | 100 |
| Hydroxy-functional acrylate (60% in xylene/EPA, OH index 140) | 200 |
| Cellulose nitrate (low viscosity, 65% in alcohol) | 80 |
| Aromatic isocyanate (50% in ethyl acetate, NCO content 8%) | 150 |

In that respect it is also possible for a bonding layer further to be applied to the support film 62 of the film 5 or to the protective lacquer layer 62 of the film 6, the bonding layer facilitating subsequent overprinting of the sealing layer.

What is claimed is:

1. A security and/or valuable document comprising:

a paper support, a film element which has one or more optical security features, and a sealing layer, wherein the support has at least one through-hole, the at least one through-hole being closed by means of the film element which projects beyond the at least one through-hole on all sides, the sealing layer covers the surface of the film element at least in the region of the at least one through-hole, the sealing layer being applied to the side of the support which is in opposite relationship to the film element, the sealing layer being formed from a lacquer layer, the lacquer layer being one that can be applied by at least one of printing, scattering, sprinkling and spraying, wherein a length expansion coefficient of the sealing layer differs from a length expansion coefficient of the film element by not more than 10% and/or a modulus of elasticity of the sealing layer differs from a modulus of elasticity of the film element by not more than 10%.

2. A security and/or valuable document according to claim 1, wherein the sealing layer has a surface area of at least 80% the surface area of the film element.

3. A security and/or valuable document according to claim 1, wherein the area of the sealing layer has 100 to 120% of the area of the film element.

4. A security and/or valuable document according to claim 1, wherein the sealing layer is transparent.

5. A security and/or valuable document according to claim 1, wherein at least one of the sealing layer and the film element is overprinted with a printing at least in region-wise manner.

6. A security and/or valuable document according to claim 1, wherein the sealing layer is of a thickness in the range of 2 to 10 μm.

7. A security and/or valuable document according to claim 6, wherein the sealing layer is applied by printing to the support by means of a screen printing process.

8. A security and/or valuable document according to claim 1, wherein the difference between length expansion coefficients is not more than 5%.

9. A security and/or valuable document according to claim 1, wherein the difference between moduli of elasticity is not more than 5%.

10. A security and/or valuable document according to claim 1, wherein at least a portion of the sealing layer substantially extends from the covered surface of the film element to the side of the support which is in opposite relationship to the film element.

11. A security and/or valuable document according to claim 1, wherein the sealing layer is directly applied to at least a portion of cut edges forming inner surfaces of the through-hole.

12. A security and/or valuable document according to claim 1, wherein the security and/or valuable document is a banknote.

13. A security and/or valuable document, comprising:

a paper support including at least one through-hole;

a film element including at least one optical security feature, said film element covering said at least one through-hole and at least a portion of said support surrounding said at least one through-hole, said film element disposed on a first side of said support; and a sealing layer covering said at least one through-hole, said sealing layer disposed on a second side of said support opposed to said first side, wherein said sealing layer includes a lacquer, the lacquer being one that can be applied by at least one of printing, scattering, sprinkling and spraying, wherein an expansion coefficient of the sealing layer differs from an expansion coefficient of the film element by not more than 10% and/or a modulus of elasticity of the sealing layer differs by not more than 10% from a modulus of elasticity of the film element.

14. A security and/or valuable document according to claim 13, wherein said security document includes a banknote.

15. A security and/or valuable document according to claim 13, wherein said sealing layer is additionally applied by at least one other method including one of printing, pouring, scattering, sprinkling and spraying.

16. A security and/or valuable document according to claim 13, wherein at least a portion of the sealing layer substantially extends from a surface of the film element to the side of the support which is in opposite relationship to the film element.

17. A security and/or valuable document according to claim 13, wherein the sealing layer is directly applied to at least a portion of cut edges forming inner surfaces of the through-hole.

* * * * *

UNITED STATES PATENT AND TRADEMARK OFFICE

CERTIFICATE OF CORRECTION

PATENT NO. : 8,132,830 B2
APPLICATION NO. : 10/599066
DATED : March 13, 2012
INVENTOR(S) : Brehm et al.

It is certified that error appears in the above-identified patent and that said Letters Patent is hereby corrected as shown below:

IN THE SPECIFICATION:

Column 1, line 59, now reads "the openings on alt sides"
should read -- the openings on all sides --

Column 4, line 63, now reads "drawings in which."
should read -- drawings in which: --

Column 5, line 53, now reads "of the openings,"
should read -- of the openings. --

Column 7, line 3, now reads "sputtering, Instead"
should read -- sputtering. Instead --

Signed and Sealed this
Nineteenth Day of February, 2013

Teresa Stanek Rea
*Acting Director of the United States Patent and Trademark Office*